US007998332B2

(12) United States Patent
Liou et al.

(10) Patent No.: US 7,998,332 B2
(45) Date of Patent: Aug. 16, 2011

(54) ELECTROPLATING METHOD

(75) Inventors: Shing-Tza Liou, Taoyuan (TW); Yao-Wen Bai, Shenzhen (CN); Rui Zhang, Shenzhen (CN); Qiu-Yue Zhang, Shenzhen (CN)

(73) Assignees: FuKui Precision Component (Shenzhen) Co., Ltd., Shenzhen, Guangdong Province (CN); Foxconn Advanced Technology Inc., Tayuan, Taoyuan (TW)

( * ) Notice: Subject to any disclaimer, the term of this patent is extended or adjusted under 35 U.S.C. 154(b) by 574 days.

(21) Appl. No.: 12/164,429

(22) Filed: Jun. 30, 2008

(65) Prior Publication Data

US 2009/0159452 A1 Jun. 25, 2009

(30) Foreign Application Priority Data

Dec. 19, 2007 (CN) ..... 2007 1 0203211

(51) Int. Cl.
*C25D 5/02* (2006.01)

(52) U.S. Cl. ..... 205/134

(58) Field of Classification Search ..... 205/118, 205/134

See application file for complete search history.

(56) References Cited

U.S. PATENT DOCUMENTS 4,439,281 A * 3/1984 Schneider et al. ..... 29/877

* cited by examiner

*Primary Examiner* — Luan Van

(74) *Attorney, Agent, or Firm* — Andrew C. Cheng

(57) ABSTRACT

An electroplating method includes steps of: providing a substrate having a first portion and a second portion connected to the first portion; forming a metallic layer on a surface of the second portion; immersing the first portion of the substrate in an electrolyte solution, applying a current to the metallic layer to electroplate the first portion of the substrate with a metal layer; and moving the substrate in a direction away from the electrolyte solution during electroplating the first portion of the substrate. The method can improve a uniformity of the obtained plating layer.

8 Claims, 7 Drawing Sheets

ELECTROPLATING METHOD

BACKGROUND

1. Technical Field

The present invention generally relates to an electroplating method, and particularly, relates to an electroplating method for an insulative substrate.

2. Discussion of Related Art

Properties of carbon fibers such as high tensile strength, low weight, low thermal expansion, high electrical conductivity and heat conductivity make it very popular in many fields such as aerospace and motorsports. Generally, carbon fibers are widely employed in composite materials to improve performance thereof. For example, a copper-carbon fiber composite is disclosed in Keiidhi Kuniya et al. Development of Copper-Carbon Fiber Composite for Electrodes of Power Semiconductor Devices, IEEE Transactions on Components, Hybrids, and Manufacturing Technology, vol. 6, No. 4, pp. 467-472, Dec. 1983.

It is to be understood that in metal-carbon fiber composite, carbon fibers and metal cannot thoroughly soaked with each other due to the differences of surface properties. In order to improve a bonding between metal and carbon fibers, carbon fibers are usually pre-processed using electroless plating, electroplating, physical vapor deposition, or chemical vapor deposition. Electroplating is highly preferred for its simple process, low cost and high level plating layer.

Currently, carbon fibers are immersed in a plating bath and connected to an electrode during a plating process, a redox reaction occurs on surfaces of carbon fibers and plating layer is thereby deposited. However, a current distribution density is non-uniform on surfaces of carbon fibers; as a result, deposition speed of metal particles is also non-uniform. Specifically, the closer the carbon fibers are to the electrode, the higher the particles deposition speed. Therefore, the obtained plating layer is non-uniform, metal-carbon fiber composite made from such carbon fibers can't reach its expected performance. Therefore, there is a desire to develop a method of forming a uniform plating layer.

SUMMARY

An electroplating method includes steps of: providing a substrate having a first portion and a second portion connected to the first portion; forming a metallic layer on a surface of the second portion; immersing the first portion of the substrate in an electrolyte solution, applying a current to the metallic layer to electroplate the first portion of the substrate with a metal layer; and moving the substrate in a direction away from the electrolyte solution during electroplating the first portion of the substrate.

This and other features and advantages of the present invention as well as the preferred embodiments thereof and an electroplating method in accordance with the invention will become apparent from the following detailed description and the descriptions of the drawings.

BRIEF DESCRIPTION OF THE DRAWINGS

Many aspects of the present invention can be better understood with reference to the following drawings. The components in the drawings are not necessarily drawn to scale, the emphasis instead being placed upon clearly illustrating the principles of the present invention.

DETAILED DESCRIPTION OF THE PREFERRED EMBODIMENTS

Figure 1:
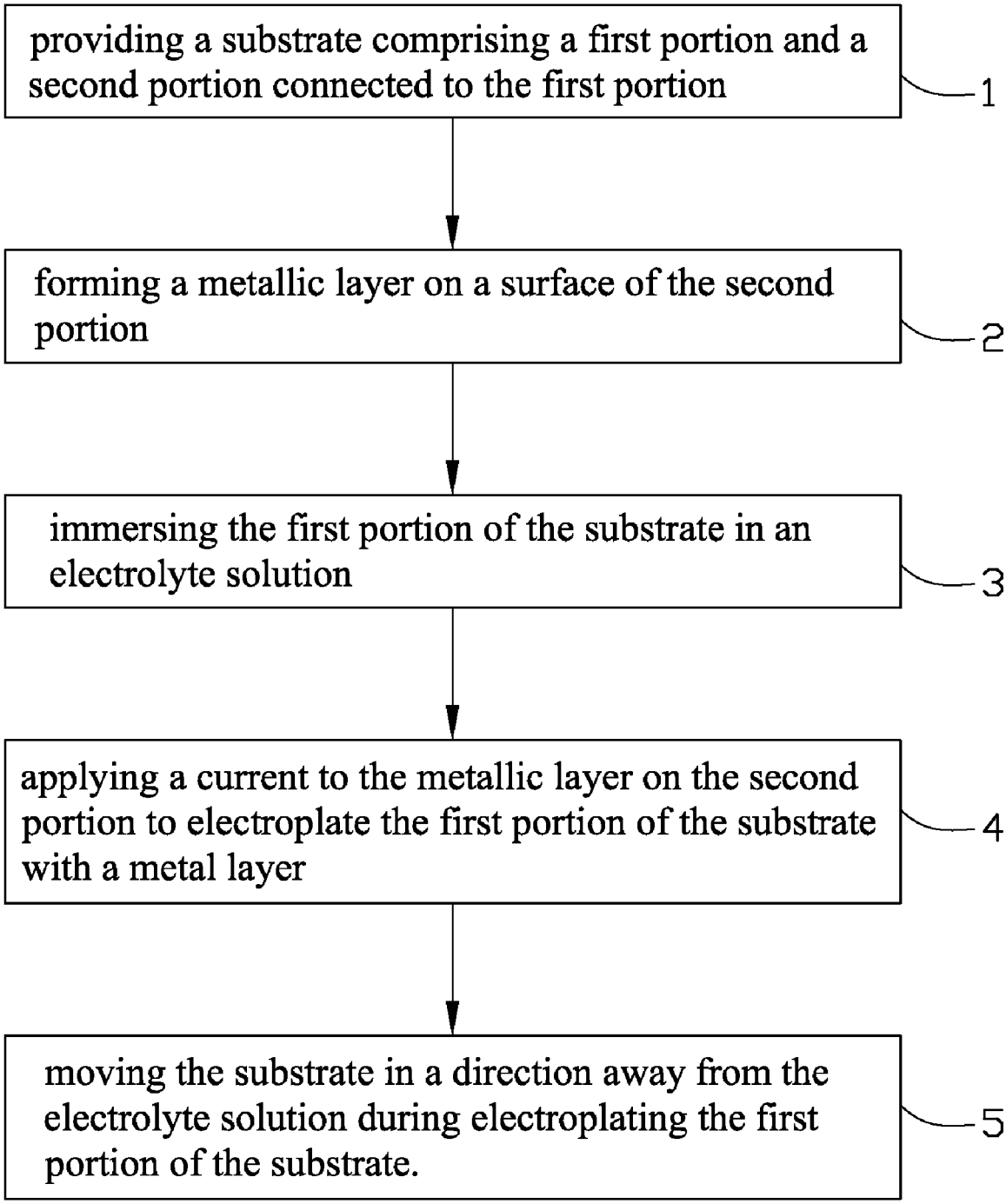
FIG. 1 is flow chart of a method of forming a plating layer on a substrate.

FIG. 1 illustrates a method of forming a plating layer on a substrate, the method will be described in detail accompany with reference to FIGS. 2 to 7.

Figure 2:
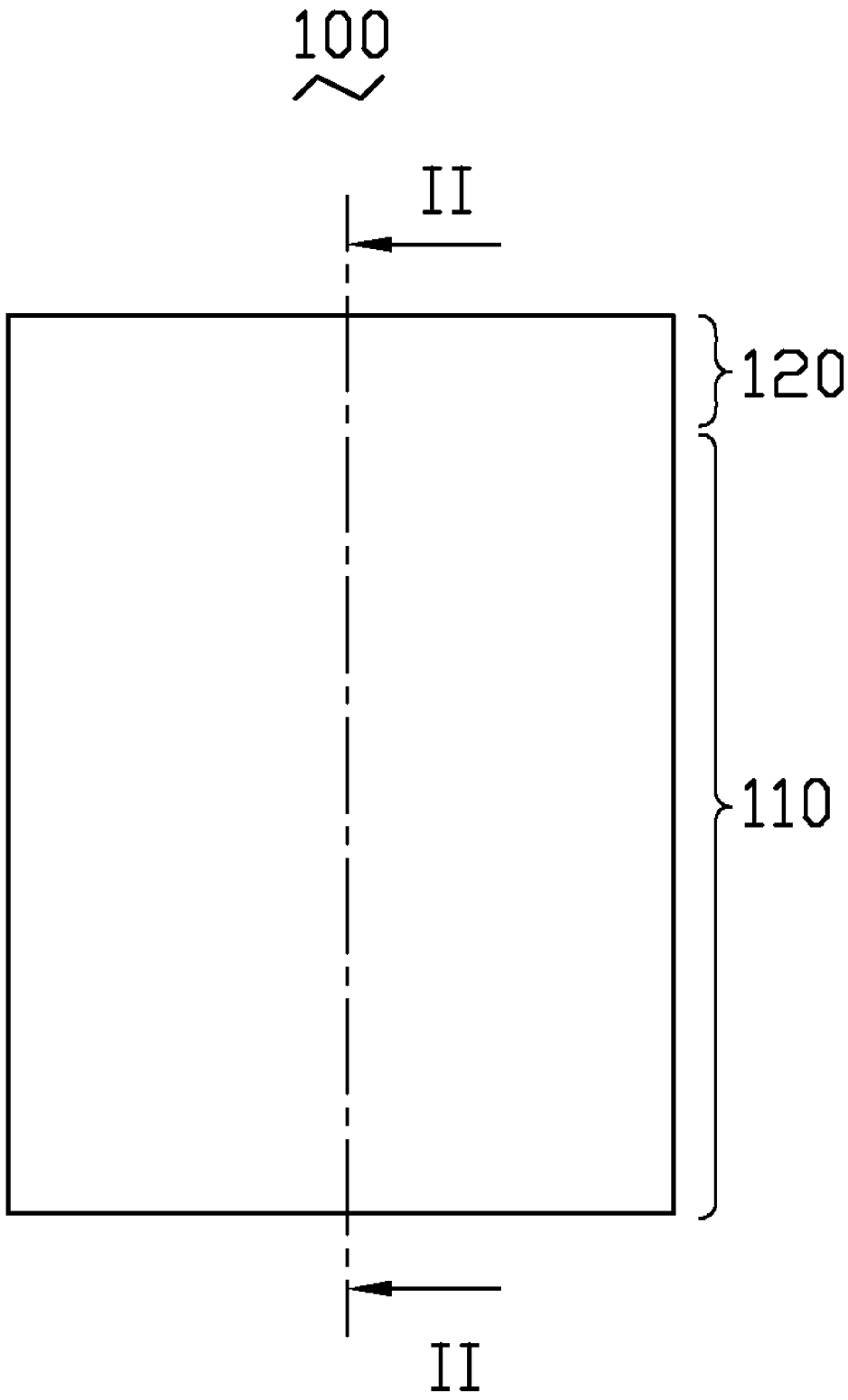
FIG. 2 is a schematic view showing a substrate including a first portion and a second portion.
Figure 3:
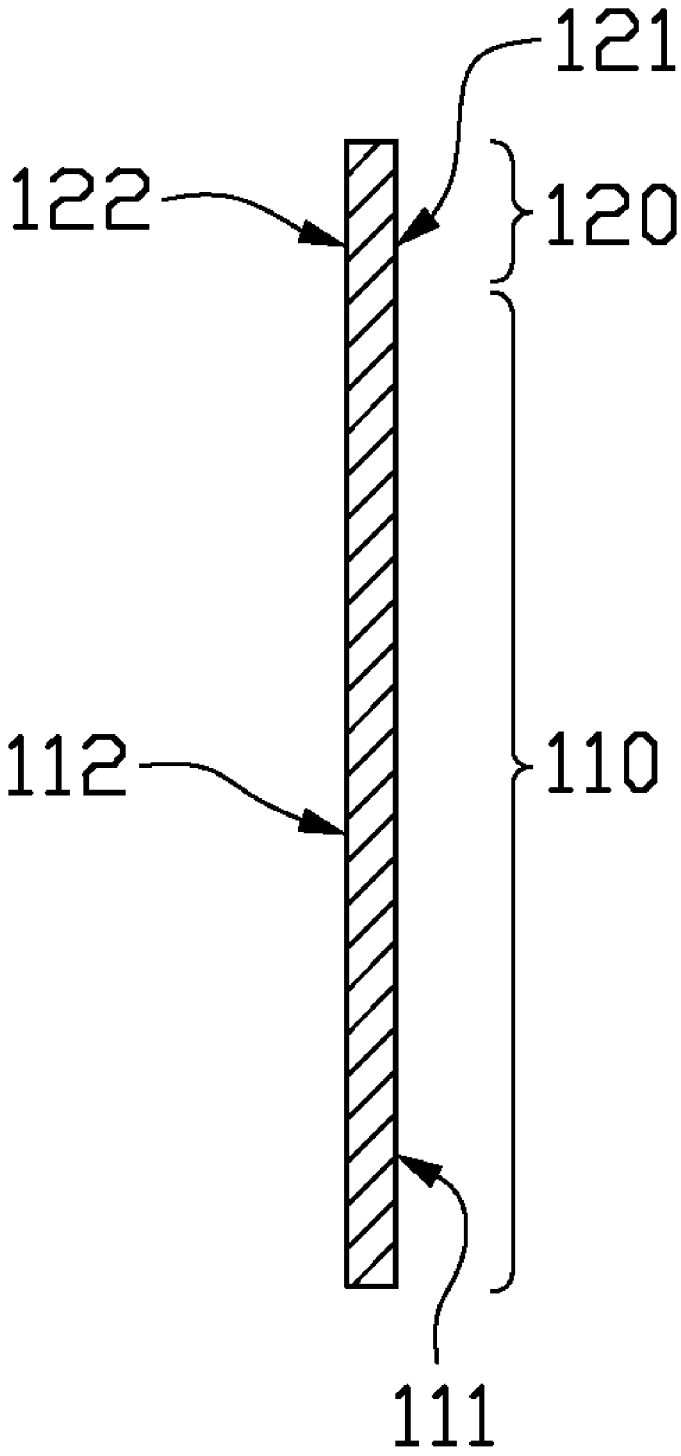
FIG. 3 is cross sectional view of FIG. 1 along a line II-II.

In step 1, as shown in FIG. 2, a rectangular substrate 100 to be electroplated is provided, the substrate 100 includes a first portion 110 and a second portion 120 connected to the first portion 110. Referring to FIG. 3, the first portion 110 has a surface 111. The second portion 120 has a surface 121.

The substrate 100 is made of an dielectric material, for example, carbon fiber or plastic. Examples of plastic include polypropylene, polycarbonate, and copolymer of propylene, butadiene and styrene. Silks can be spun from above materials and the substrate 100 can be woven from the plastic silks. In the present embodiment, the substrate 100 is made of carbon fiber, and a thickness of the substrate 100 is in a range from about 1 micrometer to 100 micrometers. The substrate 100 is a rectangular shaped sheet. However, it is understood that the substrate 100 can also be threadlike or club-shaped. In order to remove dust and smear attached on the substrate 100, the substrate is processed using plasma or an acid solution.

Figure 4:
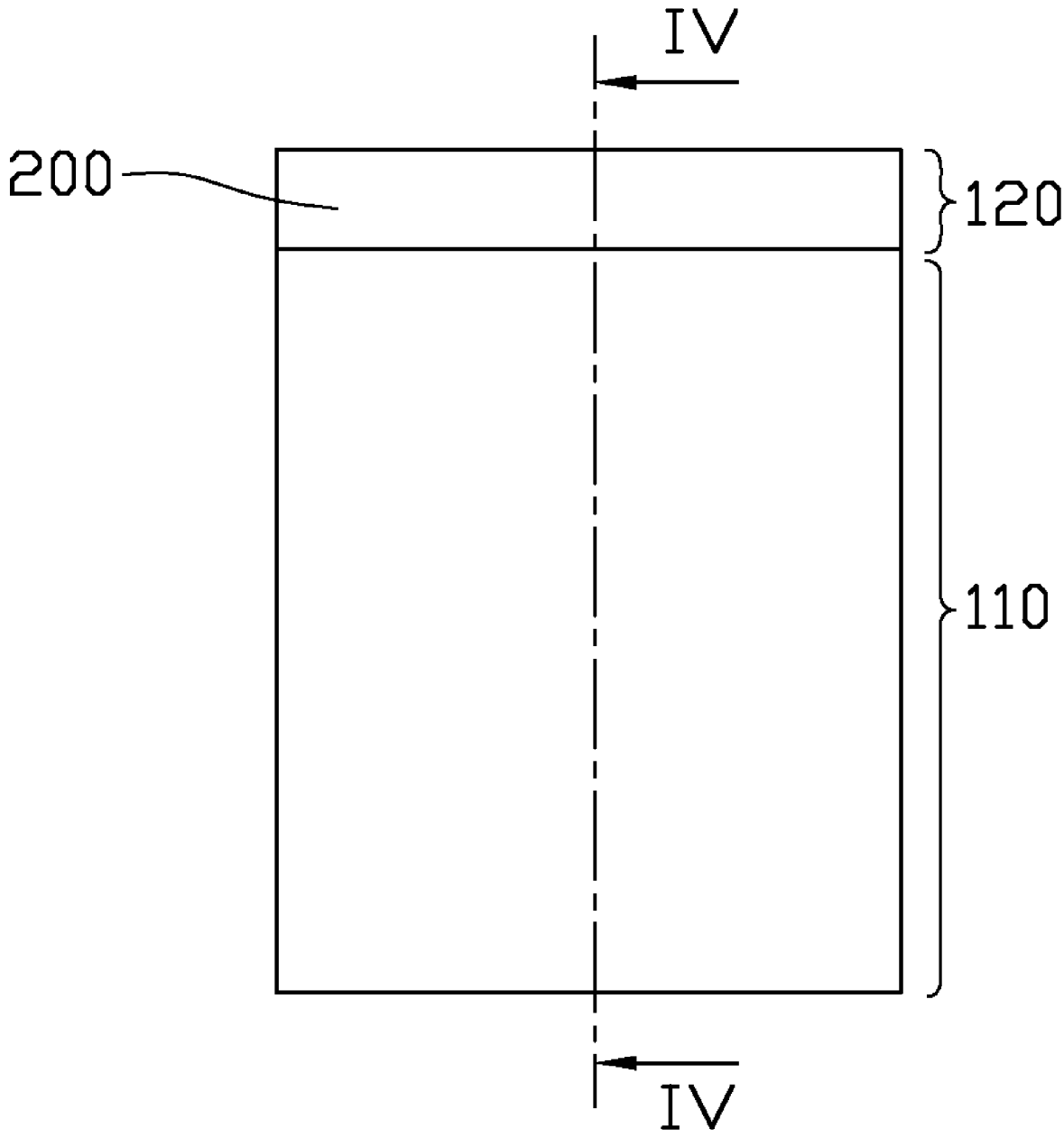
FIG. 4 is a schematic view showing an metallic layer is formed on the second portion of the substrate of FIG. 1.
Figure 5:
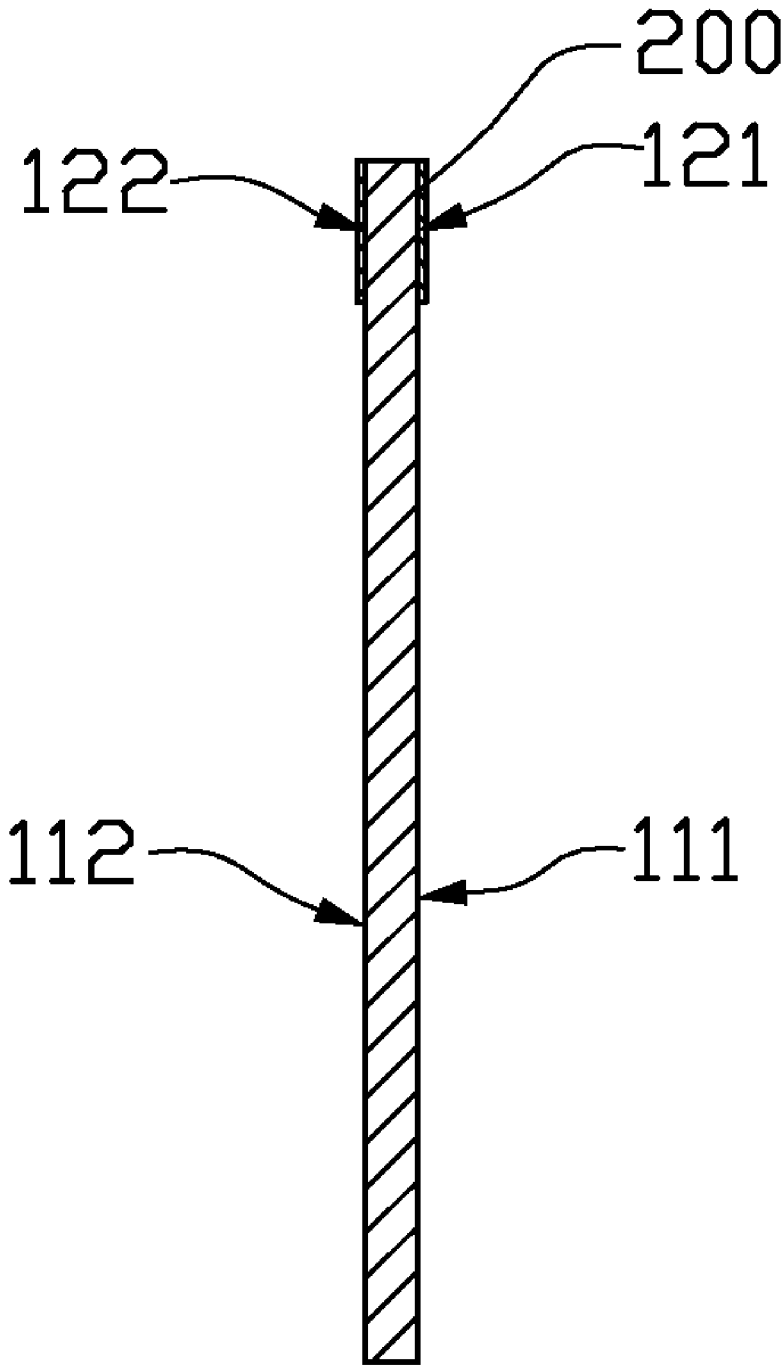
FIG. 5 is a cross sectional view of FIG. 3 along a line IV-IV.

In step 2, an metallic layer 200 is formed or disposed on a surface of the second portion 120. Referring to FIGS. 4 and 5, the metallic layer 200 is connected to the first portion 110 and is configured for improving distribution uniformity of an electroplated layer formed on the surface of the first portion 110. During a sequential process for electroplating the electroplated layer on the surface of the first portion 110, the metallic layer 200 formed on the surface of the second portion 120 is functioned as an electrode. Thus, the electroplated layer with high distribution uniformity is formed in a width direction on a surface of the first portion 110 near to the metallic layer 200. Generally, in order to ensure a current distribution density in a width direction of the first portion 110, a width of the metallic layer 200 is equal to or larger than that of the first portion 110 and the second portion 120.

In this embodiment, the substrate 100 is a carbon fiber cloth. The first portion 110 and the second portion 120 have a same width. Electrically conductive silver pastes are coated on entire surfaces 121, 122 and then cured, thereby forming the metallic layer 200. It is understood that other metals such as aurum, copper, nickel and aluminum can also be used to make electrically conductive pastes for the metallic layer 200. In addition, the metallic layer 200 can also be formed by laminating a layer of electrically conductive metal powder on the two surfaces 121, 122 or disposing sheet metals on the two surfaces 121, 122. Sheet metals are especially convenient when substrate 100 is threadlike shaped. In such condition, the substrate 100 can be clamped between two sheet metals.

Figure 6:
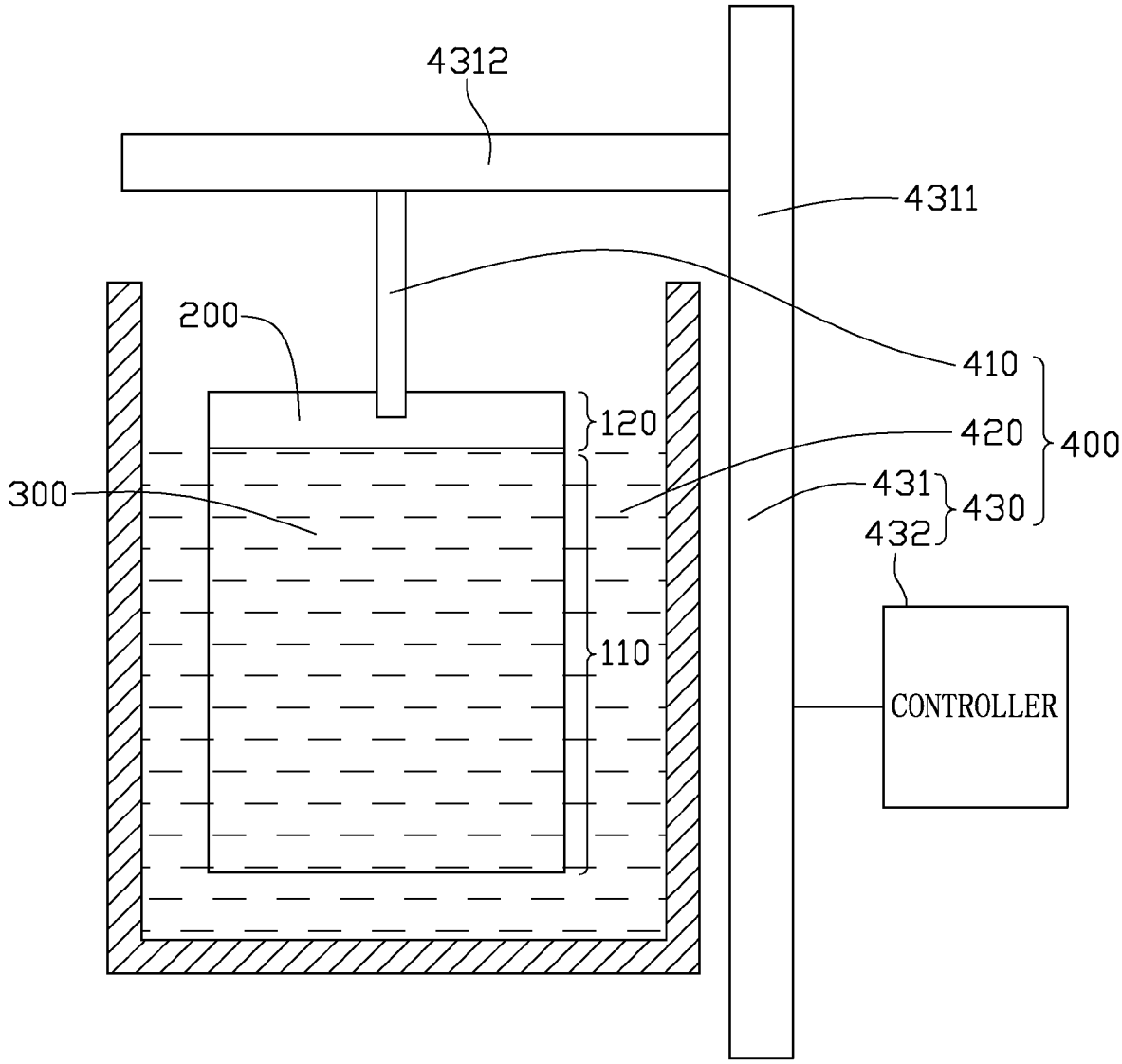
FIG. 6 is a schematic view showing the substrate is plated in a plating system.
Figure 7:
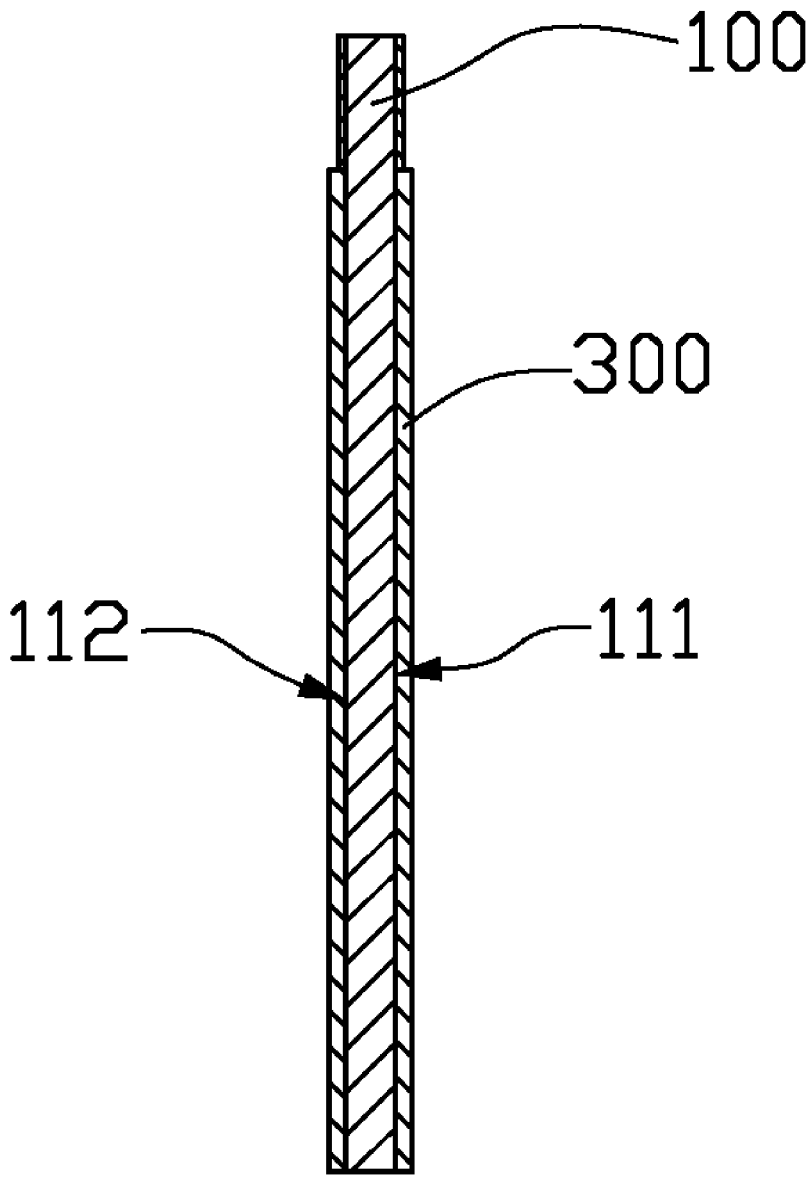
FIG. 7 is a schematic view showing a uniform plating layer is formed on the substrate of FIG. 1.

In step 3, referring to FIG. 6, the first portion 110 of the substrate 100 is immersed into an electrolyte solution, and then in step 4 a current is applied to the metallic layer 200 on the second portion 120 for depositing a plating layer 300 on two opposite surfaces 111, 112 of the first portion 110. These steps are performed in an electroplating apparatus 400, which includes a cathode 410, an anode (not show), a plating bath 420, and an elevating system 430 disposed on an operating table (not shown). The cathode 410 and the anode are electrically connected to a cathode and an anode of a power supply (not shown) respectively. The elevating system 430 includes an elevating means 431 and a controller 432 connected to the elevating means 431. The elevating means 431 includes a first guide rail 4311 and a second guide rail 4312 slidably disposed on the first guiding rail 4311. The second guide rail 4312 is capable of sliding along a lengthwise direction of the first guide rail 4311. The cathode 410 is fixed to the second guide rail 4312; therefore the cathode 410 can move along with the second guide rail 4312. The substrate 100 is hanged on the cathode 410 during plating; as a result, the substrate 100 can be elevated or lowered by driving the elevating system 430. The controller 432 is configured for controlling moving speed of the second guide rail 4312.

It is understood that pneumatic, fluid drive, or electric drive elevating apparatus can also be employed as the elevating means 431. In addition, both the cathode 410 and the substrate 100 can be connected to the elevating system 430. The elevating system 430 can directly control the movement of the substrate 100.

The process of depositing the plating layer 300 will be described in detail in the following context. Firstly, the metallic layer 200 is electrically connected to the cathode 410; secondly, the controller 432 controls the elevating means 431 to lower the second guide rail 4312 such that the first portion 110 of the substrate 100 is immersed in the plating bath 420; finally, the power supply is switched on, a redox reaction occurs on the two opposite surfaces 111, 112, and the plating layer 300 is thereby deposited. It is to be understood that side surfaces of the first portion 110 can also have plating layer 300 deposited thereon.

During the electroplating process, the controller 432 controls the elevating means 431 to elevate the second guide rail 4312 and the cathode 410, as a result, the substrate 100 is gradually pulled out of the plating bath 420. Therefore, plating time in different areas of the two opposite surfaces 111, 112 is different, specifically, plating time gradually increases from an end of the first portion 110 that adjacent to the second portion 120 (hereinafter as proximal end) to the opposite end (hereinafter as distal end). In contrast, a current distribution density gradually decreases from the proximal end to the distal end. The plating time and the current distribution density establish an equilibrium, and a uniform plating layer 300 can be obtained. In the present embodiment, the substrate 100 is elevated in a uniform motion. However, it is to be understood that the substrate 100 can be also elevated in a non-uniform motion.

When metal particles are deposited on the two opposite surfaces 111 and 112, the metal particles act as an assistant electrode which can accelerate the electroplating process and improve a uniformity of current distribution density. As a result, when the substrate 100 is pulled out of the plating bath 420, the controller 432 stops the second guide rail 4312, and the substrate 100 is removed from the second guide rail 4312 and dried, as a result, a substrate 100 with uniform plating layer 300 formed on the two opposite surfaces 111, 112 is obtained.

In order to further improve a thickness uniformity of the plating layer 300, the cathode 410 is connected to a current regulating apparatus (not shown) for regulating an output current of the cathode 410 such that current distribution density on the portion of the two opposite surfaces 111, 112 that are immersed in the plating bath 420 remain at a certain valve. For example, when the substrate 100 is elevated in a uniform motion at a velocity of v, cathode 410 has an initial output current of $I_0$, and the first portion 100 has a length of L, the current regulating apparatus decreases the output current of the cathode 410 at an acceleration of $\Delta I$, wherein $\Delta I$ satisfy a equation of $\Delta I = vI_0/L$.

The second portion 120 and the metallic layer 200 can be removed according to a practical demand. For example, the substrate 100 can be cut along a boundary between the first portion 110 and the second portion 120 and the second portion 120 is removed. The remained first portion 110 has a very uniform plating layer 300.

In the present embodiment, a long contacting boundary exists between the metallic layer 200 and the first portion 110; as a result, uniformity of current distribution density in a width direction of the first portion 110 is improved and a deposition speed of plating layer 300 is substantially same in the width direction of the first portion 110. Furthermore, the substrate 100 is pulled out of the plating bath 420 gradually, the deposited metal particles on the two opposite surfaces 111, 112 act as assistant electrode which can improve a current distribution density of the portion of opposite surfaces 111, 112 immersed in the plating bath, as a result, a thickness of the plating layer 300 is further improved.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. An electroplating method comprising:

providing a substrate comprising a first portion and a second portion connected to the first portion;

forming a metallic layer on a surface of the second portion; and immersing only the first portion of the substrate in an electrolyte solution, applying a current to the metallic layer on the second portion to electroplate the first portion of the substrate with a metal layer; and moving the substrate in a direction away from the electrolyte solution during electroplating the first portion of the substrate, wherein the substrate is comprised of carbon fibers.

2. The electroplating method as claimed in claim 1, wherein the metallic layer on the second portion is formed by applying an electrically conductive paste on the surface of the second portion.

3. The electroplating method as claimed in claim 2, wherein the electrically conductive paste is comprised of silver, gold, copper, nickel, aluminum and an alloy thereof.

4. The electroplating method as claimed in claim 1, wherein the metallic layer is formed by applying metal powders on the second portion.

5. The electroplating method as claimed in claim 1, wherein the metallic layer is a metal plate attached to the second portion.

6. The electroplating method as claimed in claim 1, wherein the substrate is moved in an uniform rectilinear motion.

7. The electroplating method as claimed in claim 1, wherein the current applied to the metallic layer decreases at an acceleration of $vI_0/L$, wherein v represents a moving velocity of the substrate, $I_0$ represents an initial current applied to the metallic layer, and L represents a length of the first portion.

8. The electroplating method as claimed in claim 1, further comprising a step of removing the second portion from the substrate.

* * * * *